United States Patent [19]

Booher, Jr. et al.

[11] B 3,992,127

[45] Nov. 16, 1976

[54] STATOR VANE ASSEMBLY FOR GAS TURBINES

[75] Inventors: Claude R. Booher, Jr., West Chester, Pa.; Elbert H. Wiley, Wenonah, N.J.

[73] Assignee: Westinghouse Electric Corporation, Pittsburgh, Pa.

[22] Filed: Mar. 28, 1975

[21] Appl. No.: 563,412

[44] Published under the second Trial Voluntary Protest Program on February 24, 1976 as document No. B 563,412.

[52] U.S. Cl. ..... 415/136; 415/200; 415/214; 415/217

[51] Int. Cl.[2] ..... F01D 9/02; F01D 5/14

[58] Field of Search ..... 415/134, 135, 136, 137, 415/138, 139, 217, 200, 214

[56] References Cited

UNITED STATES PATENTS

| | | | |
|---|---|---|---|
| 1,891,948 | 12/1932 | Rice | 416/500 |
| 2,595,829 | 5/1952 | Dean | 416/500 |
| 2,801,076 | 7/1957 | Terrell et al. | 415/200 |
| 2,819,869 | 1/1958 | Meyer, Jr. | 416/500 |
| 3,843,279 | 10/1974 | Crossley et al. | 415/138 |
| 3,857,649 | 12/1974 | Schaller et al. | 415/217 |
| 3,864,056 | 2/1975 | Gabriel et al. | 415/116 |
| 3,867,065 | 2/1975 | Schaller et al. | 415/214 |

FOREIGN PATENTS OR APPLICATIONS

| | | | |
|---|---|---|---|
| 226,940 | 9/1958 | Australia | 416/500 |
| 826,673 | 1/1952 | Germany | 415/200 |
| 846,342 | 8/1952 | Germany | 415/214 |
| 919,802 | 11/1954 | Germany | 416/500 |

*Primary Examiner*—Henry F. Raduazo
*Attorney, Agent, or Firm*—G. H. Telfer

[57] ABSTRACT

A stator vane assembly is provided, particularly for the first row of stationary vanes of a gas turbine, utilizing ceramic vanes. Each individual vane assembly consists of an airfoil vane with a separate end cap at each end for supporting the vane in position. In accordance with the invention, the engaging surfaces of the vane and of each adjacent end cap are curved surfaces of compound curvature forming engaging pivot and seat surfaces, the major and minor radii of the pivot surface being less than the corresponding major and minor radii of the seat surface, and the curvature of the pivot surface being such that thermal ratcheting of the vane with respect to the end caps is prevented.

9 Claims, 12 Drawing Figures

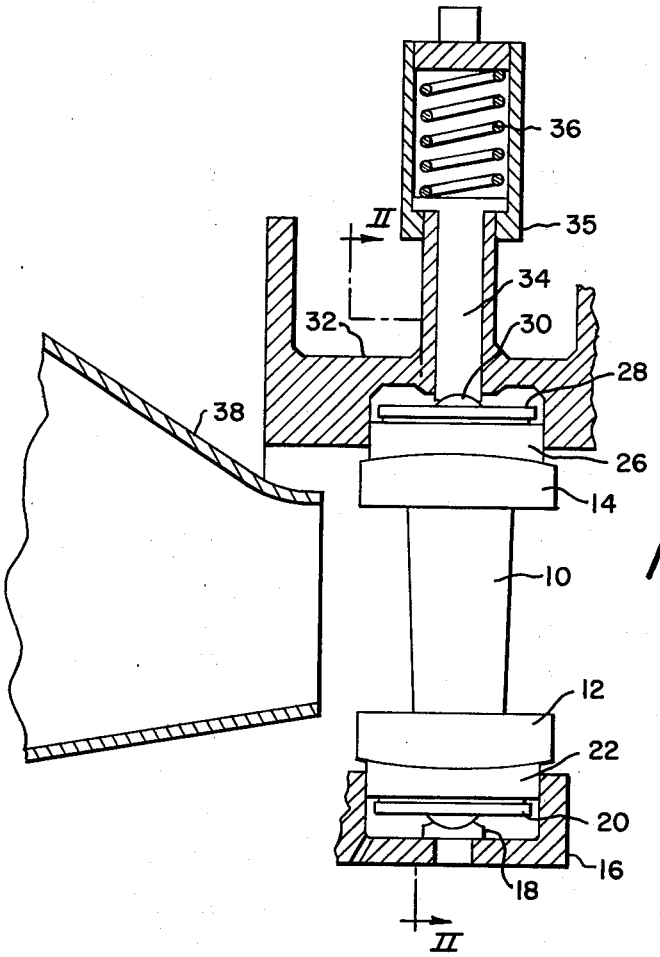
Fig. 1
Fig. 2
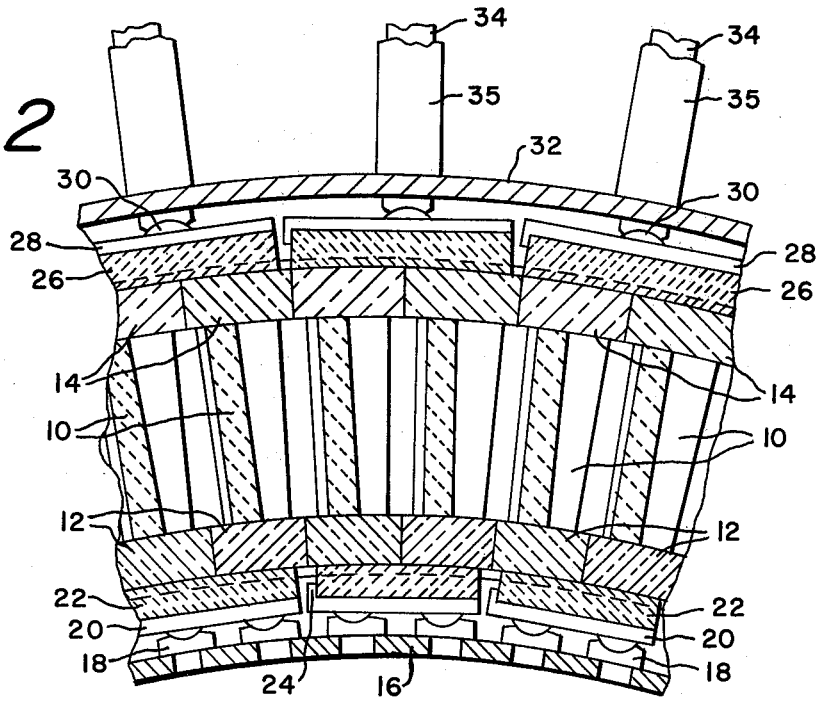

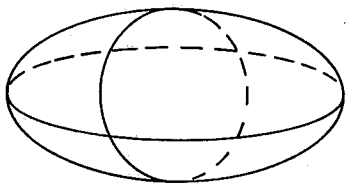
Fig. 5A
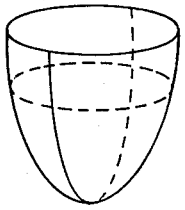
Fig. 5B
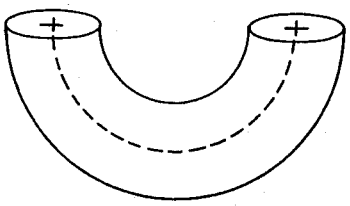
Fig. 5C
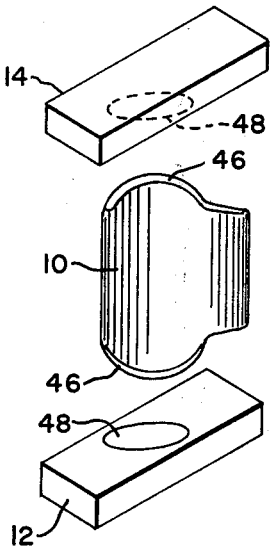
Fig. 4
Fig. 3
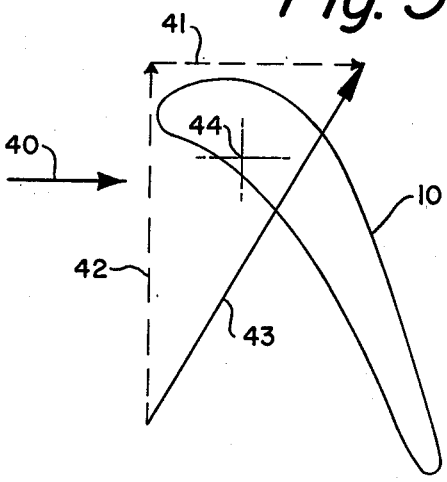

STATOR VANE ASSEMBLY FOR GAS TURBINES

The invention herein described was made in the course of or under a contract or subcontract thereunder, with the Department of the Army.

BACKGROUND OF THE INVENTION

The present invention relates to gas turbines and, more particularly, to an improved stator vane assembly using ceramic vanes.

Significant improvements can be made in the efficiency and performance of gas turbines by the use of ceramic elements to permit operation at higher temperatures or with less cooling. In particular, the use of uncooled ceramic stator vanes, especially in the first row of stationary vanes, makes possible a very substantial improvement in efficiency. Because of the mechanical properties of ceramic materials, it has been found that the most desirable construction for such a stator vane assembly involves the use of three-piece vane assemblies in which each airfoil vane is supported by a separate end cap at each end of the vane, as disclosed in a copending application of R. J. Schaller et al, Ser. No. 387,069, filed Aug. 9, 1973, now U.S. Pat. No. 3,857,649, and assigned to the Assignee of the present invention.

In the design of such a vane assembly, the junction between the airfoil vane and each of the end caps associated with it is critical. The junction must provide sufficient freedom for the vane to move relative to the end cap as necessary, and the design must be such that the junction is capable of supporting the forces applied to the vane which include not only the radial compression force for retaining the vane in position but also the forces due to the gas pressure on the vane as well as those due to thermal expansion and contraction. The junction must also maintain accurate vane-to-vane alignment in the complete assembly, and should prevent thermal ratcheting of the vane with respect to the end cap which could cause the vane to move out of position. The steady-state and transient stress concentrations, particularly in the end cap, must be minimized because of the sensitivity of ceramic materials to stress concentrations. A successful design must meet all these requirements, which precludes any simple support of the vane on the end caps.

SUMMARY OF THE INVENTION

The present invention provides a three-piece stator vane assembly which meets the requirements outlined above.

In accordance with the invention, each airfoil vane and the associated end cap at each end of the vane have interengaging surfaces constituting pivot and seat surfaces, the pivot surface preferably being formed as a tenon portion on the end of the vane and the seat surface being formed in a recess in the end cap. These engaging surfaces are curved surfaces of compound curvature, each having a major radius of curvature and a minor radius of curvature. Any suitable type of compound curved surface could be used but the preferred surface is a toroidal surface in which both major and minor radii describe circles. The major and minor radii of curvature of the pivot surface are less than the major and minor radii, respectively, of the seat surface so that the necessary freedom of relative movement with minimum stress is provided, and the length of the major radius of the pivot surface is made such that sufficient radial interference occurs between the vane and the end cap to prevent thermal ratcheting of the vane. A junction between the vane and end cap is thus provided which fully meets the requirements outlined above and which can be manufactured with minimum difficulty.

BRIEF DESCRIPTION OF THE DRAWINGS

The invention will be more fully understood from the following detailed description, taken in connection with the accompanying drawings, in which:

FIG. 1 is a fragmentary longitudinal sectional view of the stator member of a gas turbine showing only the first row of stator vanes;

FIG. 2 is a transverse sectional view on the line II—II of FIG. 1;

FIG. 3 is a diagram illustrating the forces applied to a stator vane;

FIG. 4 is an exploded perspective view showing a vane assembly embodying the invention;

FIGS. 5A-5C are diagrams illustrating compound curved surfaces suitable for use in the present invention;

DESCRIPTION OF THE PREFERRED EMBODIMENT

Figure 6:
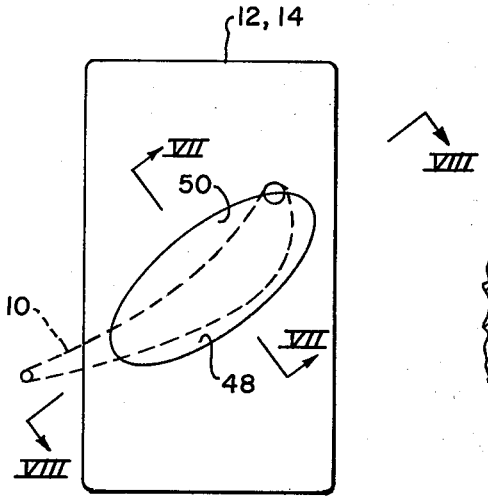
FIG. 6 is a top view of an end cap embodying the invention.

The invention is shown in the drawings embodied in a stator vane assembly for a gas turbine of the type shown in the above-mentioned application, the assembly shown being the first row of stator vanes although the invention is not limited to the first row. As shown in FIGS. 1 and 2, the assembly includes a plurality of stator vanes 10 of the usual airfoil cross section, each vane being supported between inner and outer end caps 12 and 14. The vanes are disposed in a circular array and the assembly is supported on an inner housing ring 16 which may be of any suitable or usual construction. Inner pivots 18 corresponding in position to the vanes 10 are mounted in any suitable manner in the housing ring 16 and metal shoes 20 carrying corresponding pivot members engage the pivots 18 as shown. An insulator 22 rests on each shoe 20, the shoes having lips 24 engaging the insulators to hold them against circumferential movement. The insulators 22 may be made of any suitable refractory material of low thermal conductivity such as hot pressed boron nitride or lithium aluminum silicate, for example. Two inner end caps 12 rest on each insulator 22 and the inner end of a vane 10 is supported on each of the end caps 12.

An outer end cap 14 is disposed at the other end of each vane 10 to support the outer end of the vane. Outer insulators 26, similar to the insulators 22, each engage two of the outer end caps 14. The insulators and the inner and outer end caps are preferably curved in the axial direction of the turbine, as shown, to prevent axial movement of the end caps. A shoe 28 carrying a pivot 30 engages each of the insulators 26. An outer housing ring 32 of any suitable construction encloses the assembly and carries a plurality of pressure members 34 into suitable housings 35. Each of the pressure members engages one of the outer pivots 30 and is loaded in the radial direction by a compression spring 36 to apply a radial compressive force to the vanes 10 to hold them in position. It will be understood that the assembly so far described is to be taken as representative of any suitable first row stator vane assembly for a gas turbine. In use, hot pressurized gas is directed through transition members 38 from the combustors and is directed by the vanes 10 to the first stage blades of a rotor (not shown) immediately adjacent the vanes 10. The rotor and other parts of the turbine may be of usual or desired construction.

The stator vanes 10 and end caps 12 and 14 are made of a suitable ceramic material such as high density, hot-pressed silicon nitride or silicon carbide. It has been found, as disclosed in the above-mentioned copending application, that such ceramic vanes are preferably made as a three-piece assembly in which the end caps are separate members from the vane itself, the vanes being supported by the end caps in the complete assembly as shown in FIGS. 1 and 2. The three-piece construction is highly advantageous since it permits a design which tends to minimize the component stress with minimum size, and which tends to minimize the amount of machining required which is very expensive with the hard ceramic material. The three-piece design also minimizes the gas load bending stresses in the vane itself and thermal stresses in the junctions with the end cap.

While the three-piece design is very desirable for the reasons indicated, it involves certain problems. The junction between the vane and each end cap must provide sufficient freedom for the necessary relative movement but no simple support for the vane will provide this freedom and at the same time withstand the forces to which the vane is subjected. Thus, referring particularly to FIG. 3, there is shown a section of an airfoil vane 10. Gas is directed against the vane in the direction of the arrow 40 and results in longitudinal and circumferential forces represented by the vectors 41 and 42, respectively, which apply bending forces to the vane in the directions indicated. The resultant 43 of these forces applies a twisting moment about the centroid 44 of the airfoil section. In addition to these forces, a vertical or radial force is applied through the end caps by the spring 36 to retain the vane in position, and additional forces occur due to thermal expansion and contraction. The junction between the vane and each end cap must be such as to adequately support all these forces without exceeding permissible stresses, and must permit sufficient relative movement to minimize the bending stresses at the mid-point of the vane and the bending stresses at the junction due to the critical startup and shutdown transient thermal shock environment of the turbine. In addition, the junction must provide accurate vane-to-vane alignment around the circular array of vanes, with proper stability between the vanes and end caps, and should also prevent thermal ratcheting which can cause movement of the vane with respect to the end cap due to repeated cycles of thermal expansion and contraction. The combination of these various loads and forces results in both normal (with respect to contact surface) or Hertzian contact stresses and tractive (surface shear) stresses between the engaging surfaces of the vane and end caps. In addition, both steady-state and transient stress concentrations are present which must be minimized because of the sensitivity of the ceramic material to stress concentrations. It will be apparent that all these requirements cannot be met by the simple type of support shown in the prior application mentioned above.

In accordance with the present invention, as shown generally in the exploded view of FIG. 4, the engaging surfaces of the vane and end caps are curved surfaces. Each end of the vane 10 and the corresponding end caps 12 and 14 have interengaging surfaces which form a pivot surface and a seat surface. In the preferred embodiment shown, the vane has an extending curved end or tenon portion 46 at each end forming pivot surfaces adapted to engage in recesses 48 in the end caps which provide curved seat surfaces. It has been found that the requirements discussed above can be satisfied if the engaging seat and pivot surfaces are curved surfaces of compound curvature having a major radius of curvature and a minor radius of curvature. That is, the surface is such that a section in one direction is a curve of greater radius of curvature than that of the curve formed by a section in a transverse direction. The radii are chosen so that the major and minor radii of curvature of the pivot surface are less than the major and minor radii, respectively, of the seat surface to allow the necessary freedom of movement.

Examples of suitable surfaces are shown diagrammatically in FIGS. 5A–5C. FIG. 5A shows an ellipsoidal surface such that a section in the longitudinal direction is an ellipse having a variable major radius of curvature while a section in the transverse direction is a circle having a smaller constant minor radius of curvature. FIG. 5B shows a somewhat more complicated elliptic parabolic surface in which any section in one direction is a parabolic curve while a section in the transverse direction is an ellipse. In this case, either direction could have the major radius of curvature. The preferred surface, however, is a toroidal surface as shown in FIG. 5C. Such a surface has a major radius of curvature $R_1$ and a minor radius of curvature $R_2$. Since the sections of such a surface described by both the major and minor radii are circles, the surface is relatively easy to manufacture by diamond grinding and when both the vane and the end caps are provided with mating surfaces of this compound curvature, the requirements discussed above can be met. Whatever the curvature of the particular type of surface utilized may be, however, the major radius of curvature of the pivot surface is somewhat less than the major radius of curvature of the seat surface, and the minor radius of curvature of the pivot surface is somewhat less than the minor radius of curvature of the seat surface. The difference in corresponding radii may, of course, be relatively small, such as a few thousandths of an inch, but is made sufficient to permit the limited amount of relative movement between the vane and the end cap which is necessary.

Figure 7:
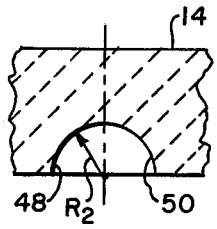
FIG. 7 is a fragmentary sectional view of the outer end cap on the line VII—VII of FIG. 6.
Figure 8:
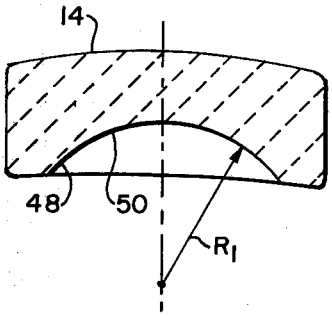
FIG. 8 is a sectional view of the end cap on the line VIII—VIII of FIG. 6.

A pivot surface is formed on each end of the vane 10 as described above to engage a corresponding seat surface formed in the recess 48 in the corresponding end cap. As shown in FIGS. 6, 7 and 8, each end cap 12 or 14 is a generally rectangular member of ceramic material, such as silicon nitride or silicon carbide, having a curved outer surface for engagement with an insulator 22 or 26 as described above. The opposite surface of the end cap has the recess 48 formed in it and provided with a curved seat surface 50 for engagement with the pivot surface of a vane 10 shown in dotted outline in FIG. 6. As shown, the seat surface is a toroidal surface, as described above, having a major radius of curvature $R_1$ and a minor radius of curvature $R_2$ . A curved surface of compound curvature is thus formed adapted to receive the correspondingly curved pivot surface of the vane.

Figure 10:
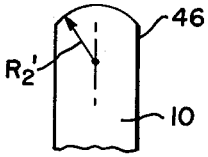
FIG. 10 is a side view of one end of a stator vane.
Figure 9:
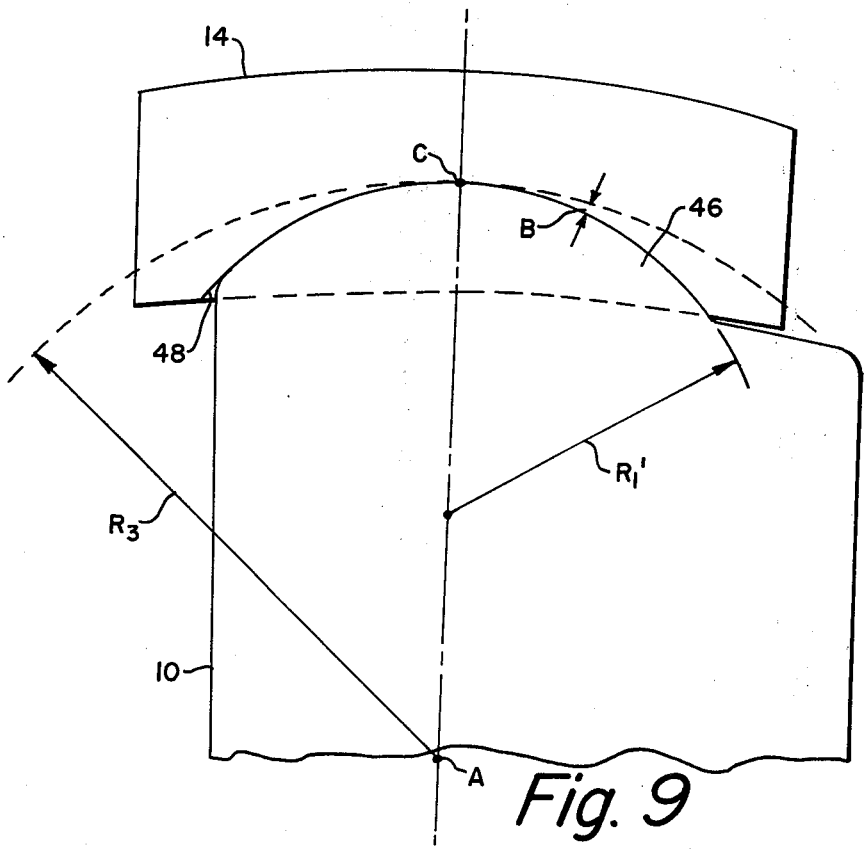
FIG. 9 is a view in elevation showing the top of a vane in engagement with an end cap.

FIGS. 9 and 10 show one end of a vane 10, the other end being of the same configuration. The extending end portion or tenon portion 46 of the vane has a toroidal surface having a major radius of curvature $R'_1$ and a minor radius of curvature $R'_2$. The pivot surface of the vane is thus formed to engage the toroidal seat surface of the end cap. As described above, the major radius $R'_1$ is made somewhat less than the major radius $R_1$ of the seat surface, and the minor radius $R'_2$ is somewhat less than the minor radius $R_2$ of the seat surface so that the engaging surfaces permit the necessary freedom of relative movement.

In accordance with a further feature of the invention, the pivot surface of the vane is so designed as to prevent thermal ratcheting of the vane. This may occur as a result of repeated cycles of thermal expansion and contraction which tends to cause the vane to pivot about its mid-point causing the outer ends to move and change position with respect to the end caps. Repeated movement of this kind on successive thermal cycles is undesirable as it may cause the vane to move into a position of misalignment or entirely out of the proper position. In accordance with the invention, this ratcheting is prevented as shown in FIG. 9. The mid-point A of the vane is at a radius $R_3$ from the highest point of the end portion 46. The distance $R_3$ is thus one-half of the radial length of the vane. The pivot surface of the vane engages in the recess 48 of the end cap and, if permitted, the vane would tend to rotate about the point A, sliding at the point C, so as to change its position with respect to the end cap in small steps as the vane expands and contracts with successive thermal cycles. This ratcheting is undesirable and, in accordance with the present invention, it is prevented by making the major radius of curvature $R'_1$ of the pivot surface different from the radius $R_3$ of the point C about the mid-point A of the vane. In the preferred embodiment shown in FIG. 9, the radius $R'_1$ is made substantially less than the radius $R_3$, that is, it is made less than half the radial height of the vane 10. This results in a radial interference, such as indicated at B, if the vane attempts to rotate about the point A, and the vane is effectively locked against such movement. Thermal ratcheting is thus prevented by proper design of the pivot surface.

While other types of curved surfaces might conceivably be utilized for the pivot and seat surfaces, the compound curved type of surface described above, and in particular a toroidal surface, has great advantages over other surfaces. For example, a cylindrical surface would result in undesirably high contact stresses, would require special end edge crowning, and would not allow the vane freedom to rotate in response to the applied forces. A spherical surface would require special stops to support the twisting load on the vane, and would result in stress concentrations in the end caps too high to be permitted. A surface of compound curvature as described avoids these difficulties and makes it readily possible to meet the requirements previously discussed.

The toroidal surface has the further advantages of being able to adequately withstand the various mechanical forces applied to the vane, as described above, as well as providing the necessary linkage stability of the vane assembly. The toroidal surface also tends to minimize contact stresses and stress concentration in the end cap and provides a relatively simple design for manufacturing purposes. Furthermore, the toroidal surface allows the contact pressure to be applied in a manner to decrease the tractive contact stresses, which tend to have high tensile stress components, and shift them to normal contact stresses which have lower tensile components and are thus more suitable for the ceramic material which has its greatest strength in compression. The toroidal surface also has the design advantage of having three basic variables, that is, the major radius, the minor radius and the depth of the end cap recess, which together with such matters as surface finish and radial tolerances can readily be optimized to meet the load requirements, friction characteristics, and material properties of a particular design.

It will now be apparent that a stator vane assembly has been provided for gas turbines, and in particular for three-piece ceramic vane assemblies in which the vane is supported by end caps at each end, which fully meets the difficult requirements for this type of service and which can easily be designed and manufactured. These advantages result from the use of the interengaging curved surfaces of compound curvature on the vane and the associated end caps. A particular preferred type of surface has been described but it will be apparent that various modifications and other designs are possible within the scope of the invention.

What is claimed is:

1. A stator vane assembly for a gas turbine comprising a plurality of airfoil vanes, an end cap at each end of each vane, said vanes and end caps being made of a ceramic material and the end caps being disposed to support the vanes in a circular array, each vane and the end caps associated therewith having interengaging surfaces constituting pivot and seat surfaces, said surfaces being curved surfaces of compound curvature having major and minor radii of curvature, the major radius of each pivot surface being less than the major radius of the corresponding seat surface and the minor radius of each pivot surface being less than the minor radius of the corresponding seat surface and resilient means for pressing said pivot and seat surfaces into engagement with each other.

2. A vane assembly as defined in claim 1 in which said surfaces are toroidal.

3. A vane assembly as defined in claim 1 in which said pivot surfaces are formed on the vanes and said seat surfaces are formed on the end caps.

4. A vane assembly as defined in claim 3 in which said surfaces are toroidal and the major radius of curvature of each pivot surface is different from one-half the radial length of the vane.

5. In a stator vane assembly for a gas turbine having a plurality of airfoil vanes disposed in a circular array, each vane having an end cap at each end thereof for supporting the vane in position, said vanes and end caps being made of a ceramic material, each vane having a curved pivot surface at each end, each end cap having a recess in its surface providing a curved seat surface for engagement with the pivot surface, said engaging surfaces being curved surfaces of compound curvature having major and minor radii of curvature, the major radius of the pivot surfaces being less than the major radius of the seat surfaces and the minor radius of the pivot surfaces being less than the minor radius of the seat surfaces and resilient means for pressing said pivot and seat surfaces into engagement with each other.

6. The combination defined in claim 5 in which said surfaces are toroidal.

7. The combination defined in claim 5 in which the curvature of the pivot surface is such that rotation of the vane relative to the end cap is limited.

8. The combination defined in claim 5 in which said surfaces are toroidal and the major radius of curvature of each pivot surface is different from one-half the radial length of the vane.

9. The combination defined in claim 8 in which said radius of curvature is less than one-half the radial length of the vane.

* * * * *